US005810164A

United States Patent [19]

Rennecamp

[11] Patent Number: 5,810,164

[45] Date of Patent: Sep. 22, 1998

[54] CIGARETTE BOX INSERT

[76] Inventor: Bryan Rennecamp, 5621 Delmar Ave., Apt. 803, St. Louis, Mo. 63112

[21] Appl. No.: 767,627

[22] Filed: Dec. 17, 1996

Related U.S. Application Data

[60] Provisional application No. 60/008,918, Dec. 20, 1995.

[51] Int. Cl.[6] ..... B65D 85/10

[52] U.S. Cl. ..... 206/256; 131/260; 131/329; 206/236; 206/244; 206/268

[58] Field of Search ..... 206/242, 256, 206/248, 236, 268, 264, 244; 211/70.3; 131/329, 260

[56] References Cited

U.S. PATENT DOCUMENTS

| | | | |
|---|---|---|---|
| 1,927,092 | 9/1933 | Howard | 131/329 X |
| 2,506,385 | 5/1950 | Roamer | 206/256 |
| 3,233,951 | 2/1966 | Deal | 131/260 X |
| 3,861,523 | 1/1975 | Fountain et al. | 206/236 |
| 4,207,976 | 6/1980 | Herman | 206/256 X |
| 4,214,658 | 7/1980 | Crow . | |
| 4,793,478 | 12/1988 | Tudor | 206/256 |
| 5,277,304 | 1/1994 | Brizzi et al. | 206/256 |
| 5,465,738 | 11/1995 | Rowland | 131/329 |

*Primary Examiner*—Bryon P. Gehman

*Attorney, Agent, or Firm*—Senniger, Powers, Leavitt & Roedel

[57] ABSTRACT

A cigarette box insert of such width, depth and height to snugly fit within a cigarette box, having a stepped top, a first receptacle being a smoking material receptacle for holding smoking material and one or more second receptacles for holding one or more pipes or cigarettes.

15 Claims, 8 Drawing Sheets

CIGARETTE BOX INSERT

This application claims benefit of USC of Provisional Application No. 60/008,948, filed Dec. 20, 1995.

BACKGROUND OF THE INVENTION

This invention relates to a cigarette box insert and device and, more particularly, to a device for use to adapt a standard cigarette box so that it holds one or more smoking pipes, one or more cigarettes, and smoking material.

Most smoking systems designed to hold a smoking pipe and smoking material are relatively bulky and inconvenient to handle and carry. Furthermore, most smoking systems for use in smoking loose smoking material have an appearance which makes it obvious that they contain a pipe and loose smoking material. This aspect is a disadvantage in situations when it is socially unacceptable to be a smoker of loose material. It is also undesirable to carry a pipe and loose smoking material in facilities which permit cigarette smoking but restrict pipe smoking.

U.S. Pat. No. 4,214,658 discloses a smoking system in which a pipe is moved into accessible position by means of a resilient element, and only when its cover is slid to the side. The '658 system is not shaped and sized to fit snugly and securely within a cigarette box, is not designed to provide access to its pipe and smoking material when opening a cigarette box, and is not designed to hold one or more cigarettes in addition to loose smoking material.

SUMMARY OF THE INVENTION

It is therefore an object of this invention to impart social acceptability to the smoking of loose material. It is another object of this invention to provide a cigarette box insert system which facilitates the carrying of a pipe and smoking material in situations where the smoking of loose material is restricted or socially unacceptable. It is a further object to provide a cigarette box insert system which renders filling of a pipe with smoking material simple. A still further object is to provide such a system in which there is a reduced risk of mishandling the pipe and spilling of smoking material. It is also an object to provide a cigarette box insert system which opens easily in conjunction with opening a cigarette box, which provides access to pipe and smoking material without use of a spring, resilient element, or other pressure means, and which is easy to clean. And it is an object to provide a cigarette box insert in which a pipe is accessible to the smoker without having to slide open a cover, and to provide a system in which the pipe is not projected outwardly from the system.

Briefly, therefore, the invention is directed to a cigarette box insert for a cigarette box of the type having a space for holding cigarettes and a hinged top. The cigarette box insert has a body having a close fit in a cigarette box, a smoking material receptacle for holding loose smoking material, and a lid for the smoking material receptacle. The smoking material receptacle has an opening at the top of the body, side walls extending down into the body, and a solid bottom, and extends less than the entire depth of the body. The lid has a sealing member for plugging the opening of the smoking material receptacle such that the smoking material receptacle is opened by upward pressure on the lid.

The invention is also directed to a cigarette box insert having a body having a smoking material receptacle for holding loose smoking material, a pipe/cigarette receptacle for holding a pipe or cigarette, and a lid for the smoking material receptacle. The smoking material receptacle has an opening at the top of the body, side walls extending down into the body, and a solid bottom, the smoking material receptacle extending less than the entire depth of the body. The pipe/cigarette receptacle has an opening at the top of the body and side walls extending down into the body. The lid has a sealing member for plugging the opening of the smoking material receptacle such that the smoking material receptacle is opened by upward pressure on the lid.

The invention is further directed to a cigarette box insert having a body having a smoking material receptacle for holding loose smoking material, and a lid for the smoking material receptacle, the body having front, back, bottom and side surfaces and being of such width, depth and height to snugly fit within a cigarette box, the smoking material receptacle having an opening at the top of the body, side walls extending down into the body, and a solid bottom, the smoking material receptacle extending less than the entire depth of the body.

Still further, the invention is directed to a cigarette box insert having a body having a smoking material receptacle therein for holding loose smoking material, and a lid for the smoking material receptacle, the body having a stepped top, a first body portion and a second body portion, each of which portions have an upper surface with the upper surface of the first body portion being at greater elevation than the upper surface of the second body portion.

The invention is also directed to a cigarette box insert having a body having a smoking material receptacle for holding loose smoking material, a pipe/cigarette receptacle for holding a pipe or cigarette, and a lid for the smoking material receptacle. The body has front, back, bottom and side surfaces, and is of such width, depth and height to snugly fit within a cigarette box. The body has a stepped top, a first body portion and a second body portion, each of which body portions has an upper surface with the upper surface of the first body portion being at greater elevation than the upper surface of the second body portion. The smoking material receptacle is housed within the first body portion and has an opening at the upper surface of the first body portion. The pipe/cigarette receptacle is housed within the second body portion and has an opening at the upper surface of the second body portion. The lid has a relatively flat top surface for adhesive securement to the cigarette box top interior surface and a sealing member for plugging the opening of the smoking material receptacle such that the smoking material receptacle is opened by upward pressure on the lid. The lid further has an integral extension which extends over the pipe/cigarette receptacle and having an opening therein aligned with the opening on the pipe/cigarette receptacle for receiving a tip of a pipe/cigarette extending out of the pipe/cigarette receptacle.

The invention is also directed to a cigarette box insert kit having a body having a smoking material receptacle for holding loose smoking material, a pipe/cigarette receptacle for holding a pipe or cigarette, and a lid for the smoking material receptacle. The body has front, back, bottom and side surfaces, and is of such width, depth and height to snugly fit within a cigarette box. The smoking material receptacle having an opening at the top of the body, side walls extends down into the body, and a solid bottom, the smoking material receptacle extending less than the entire depth of the body. The pipe/cigarette receptacle has an opening at the top of the body and side walls extending down into the body. The lid has a relatively flat top surface for adhesive securement to the cigarette box top interior surface and a sealing member for plugging the opening of the smoking material receptacle such that the smoking material receptacle is opened by upward pressure on the lid. There is double-sided tape for securement of the lid to the cigarette box top interior, and written instructions associated with the body describing assembly of the insert within the cigarette box.

Other objects and features of the invention will be in part apparent and in part pointed out below.

DETAILED DESCRIPTION OF THE INVENTION

Figure 1:
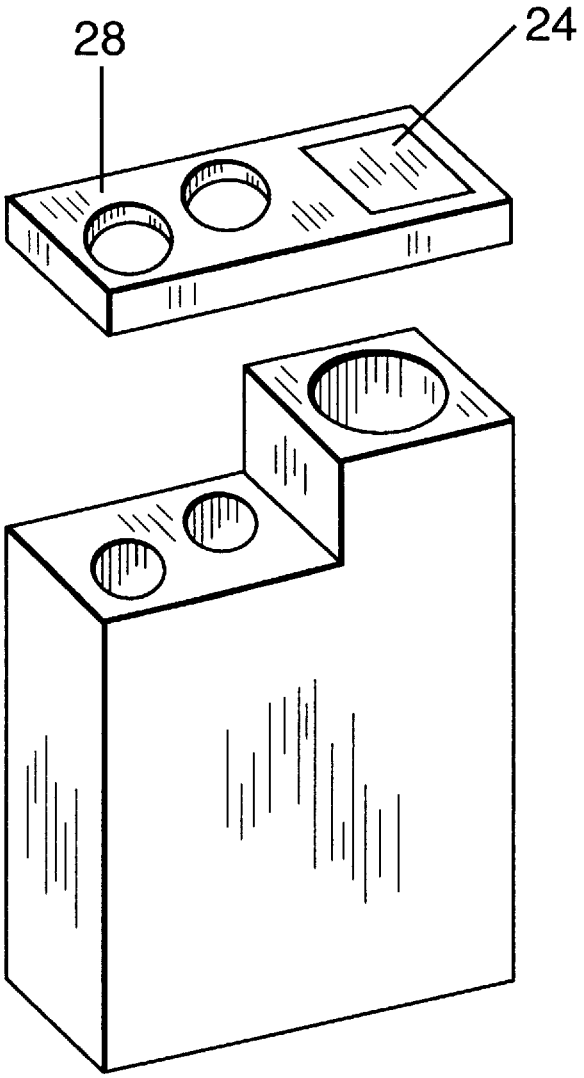
FIG. 1 is a perspective view of the invention.
Figure 2:
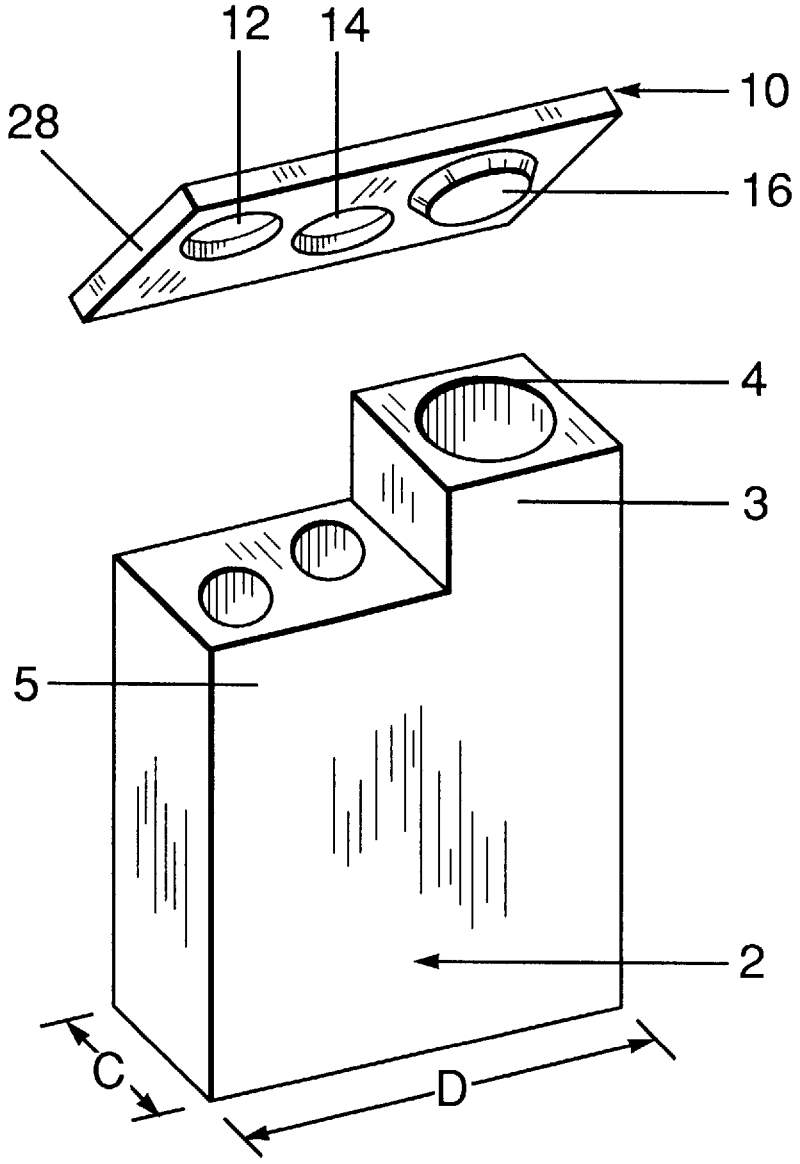
FIG. 2 is a perspective view of the invention.
Figure 3:
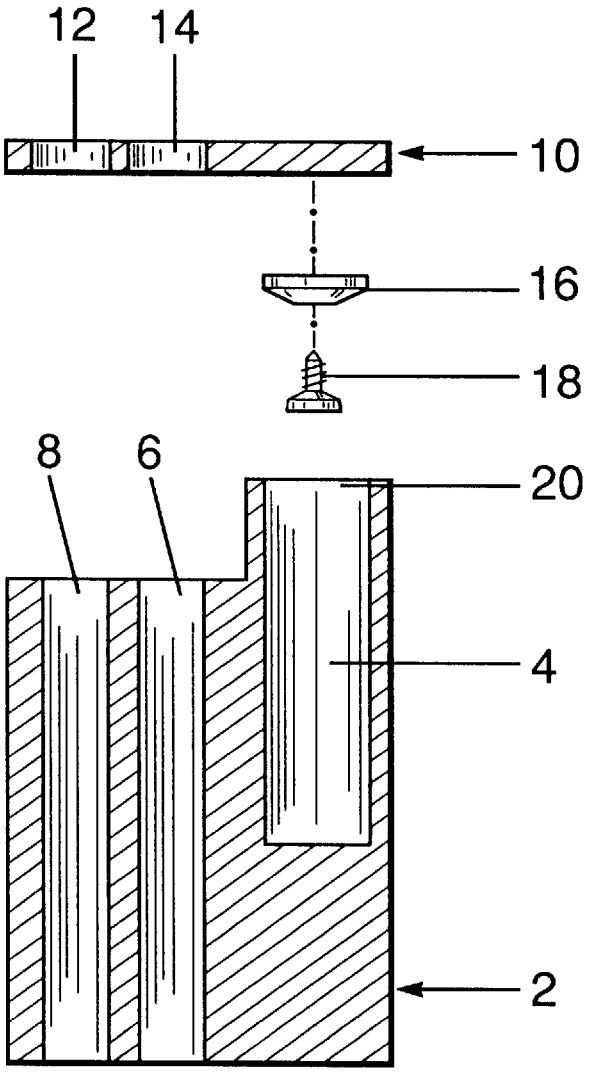
FIG. 3 is a front elevation of the invention in section.
Figure 7:
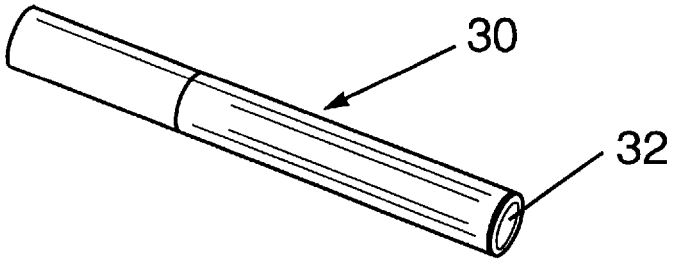
FIG. 7 is a pipe for use in conjunction with the invention.
Figure 8:
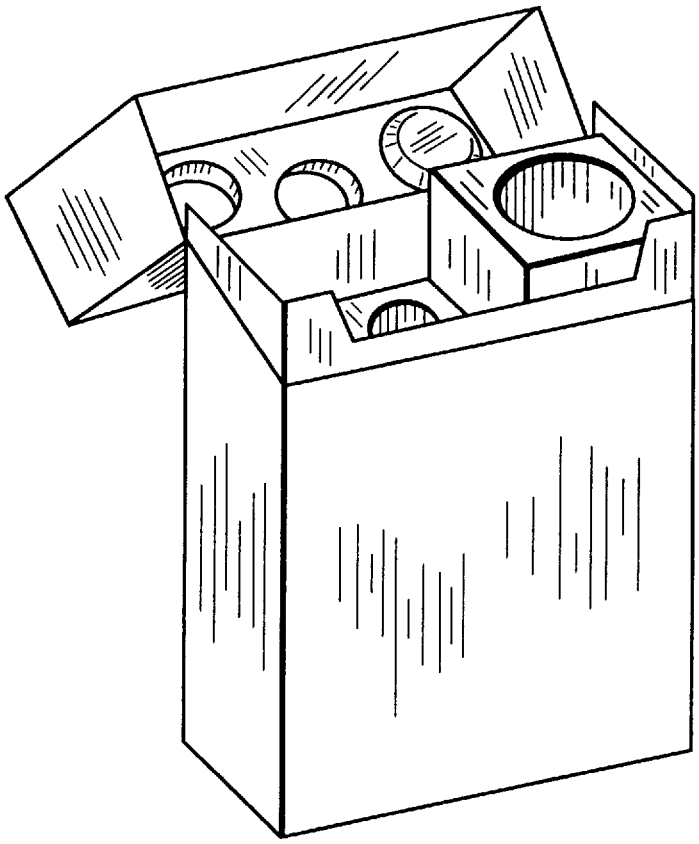
FIG. 8 is a photograph of the invention within a cigarette box.

As shown in FIGS. 1–3, the invention is a cigarette box insert having a body 2 with a receptacle 4 for storing loose smoking material. In FIG. 3 it is seen that the receptacle for loose smoking material has a solid bottom and extends less than the entire depth of the body. There is at least one pipe/cigarette receptacle 6, preferable two such receptacles 6, 8 which extend the entire depth of the body. These are sized for receiving a small pipe (FIG. 7) or a cigarette and holding it relatively secure. If the receptacles are too large, a pipe therein, which is usually metal, rattles around. If the receptacles are too small, a cigarette therein is easily damaged if not inserted and removed with an abundance of caution. It is often desirable to carry an emergency cigarette for smoking when it is not desirable to smoke loose smoking material from a pipe. The pipe/cigarette receptacle is preferably a bore through the entire depth of the body open at both ends as shown. This facilitates cleaning of the receptacle in that loose smoking material particles falling out of a cigarette stored in the receptacle or ash falling out of a pipe stored in the receptacle can easily brushed or blown through and out of the receptacle because it is open at both ends.

Figure 4:
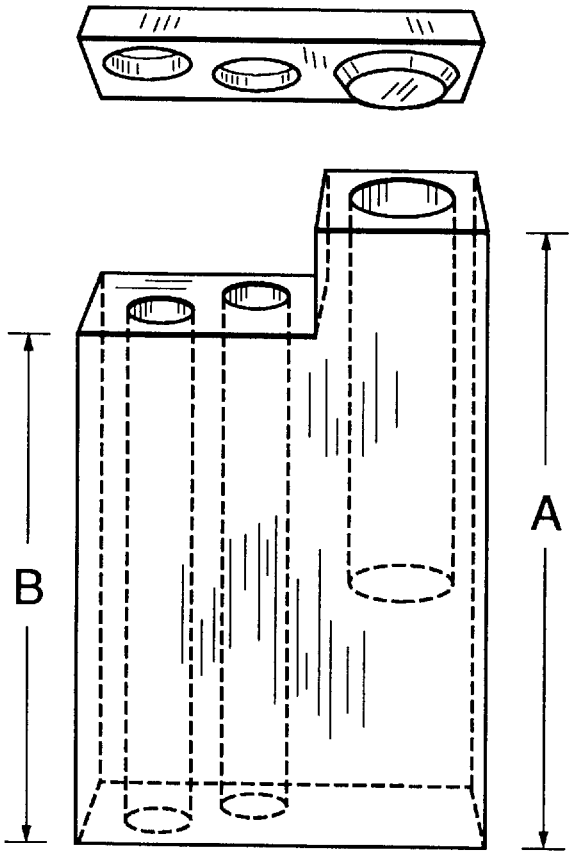
FIG. 4 is a front elevation of the invention.

The external surfaces of the body and the body itself have dimensions such that they conform to the internal surfaces of a standard cigarette box of the standard cardboard type which is sold in stores and in machines and holds 20 class A cigarettes. The body is therefore sized so that it slips easily into a cigarette box and is retained snugly therein, while still being removable for cleaning or transfer to a new cigarette box. The loose smoking material receptacle 4 is housed within first body portion 3 which has height A of at least about 2 and ¾ inches, more preferably of about 3 inches, such that it occupies at least about 80% of the height of a standard cigarette box when placed therein. It is important that the height be such the sealing member cooperates well with the opening on the smoking material receptacle. If the height is too low, the sealing member will not seal the opening. If the height is too high, the box top will not close effectively. The pipe/cigarette receptacle 6 is housed within second body portion 5 which has a height B of less than about 2.5 inches, preferably between about 2 and 2.5 inches, more preferable of about 2 and 5/16 inches, such that it occupies less than about 75% of the height of a standard cigarette box. The body therefore has a stepped top, a first body portion and a second body portion, each of which has an upper surface with the upper surface of the first body portion being at greater elevation than the upper surface of the second body portion. Dimension B is such that pipes and cigarettes in receptacles 6 and 8 are conveniently presented as shown in FIG. 4 and easily grasped by the smoker when the cigarette box is opened. Advantageously, there is no need for any mechanism to urge the pipes or cigarettes out of the receptacles. The relative dimensions A and B are such that opening 20 of the loose smoking material receptacle is close to the cigarette box top and is therefore easily opened and closed by use of a lid secured to the interior of the cigarette box top (as described below), while the openings of the pipe/cigarette receptacles 6 and 8 are significantly lower so that pipes or cigarettes therein extend upwardly (FIG. 4) to facilitate grasping such pipes or cigarettes. The dimension B is less than the length of a cigarette or cigarette-length pipe such that the pipe or cigarette therein extends out of the top of the body.

The side surfaces of the body have a dimensions C and D which are about 15/16 inch and 2 inches, respectively, such that the body is slidable into a standard cigarette box and held snugly therein. These dimensions C and D are only slightly less than the interior dimensions of standard cigarette boxes of the "flip-top" type which hold 20 class A cigarettes. All of the dimensions A–D may alternatively be such that the body conforms to the internal surfaces of a different cigarette box, such as one which is less common but holds 25 class A cigarettes, or one which holds 20"slims" or "100".

The body is made from a relatively lightweight wood or plastic material. When made from wood the receptacles may be bored or drilled out by standard techniques. When made from plastic the receptacles may be molded into the body during its formation by injection molding or other suitable technique.

Figure 5:
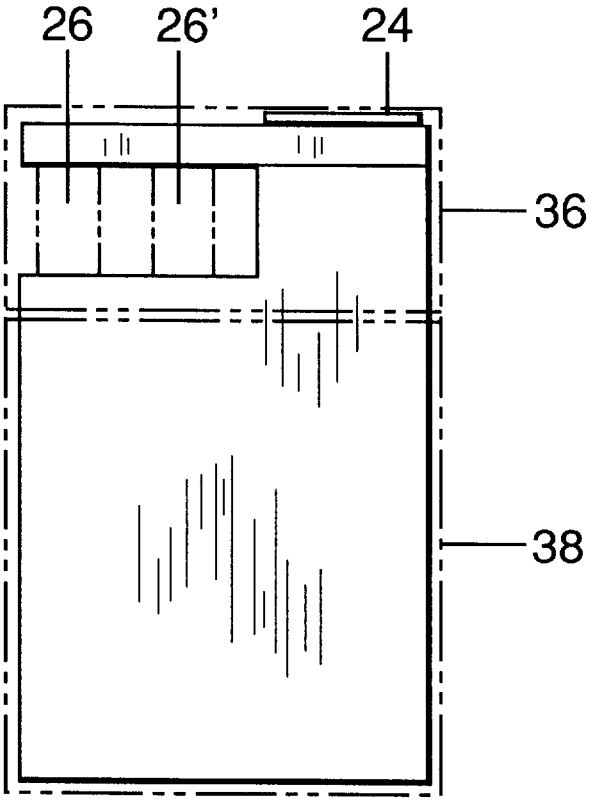
FIG. 5 is a front elevation of the invention showing cigarettes or pipes therein, with the invention inside a cigarette box 38 (in phantom) having box top 36.
Figure 6:
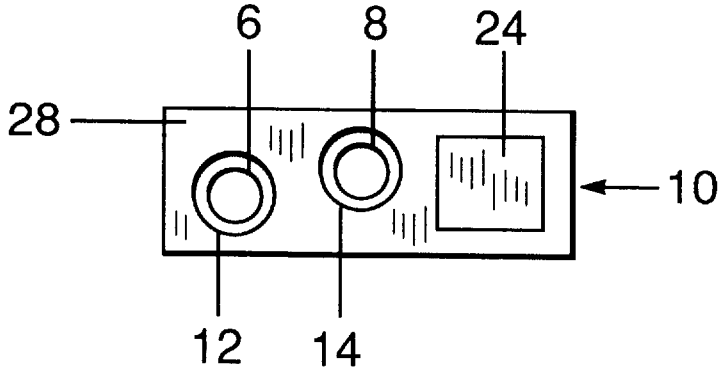
FIG. 6 is a top view of the invention.

There is a lid 10 for the loose smoking material receptacle which is made of the same wood or plastic material as the body and has a sealing member 16 which fits into opening 20 for plugging the loose smoking material receptacle. Sealing member 16 is secured to the underneath side of the lid by way of screw 18. In one preferred embodiment sealing member 16 is a rubber stopper. The top side of the lid 10 has a relatively flat surface as shown in FIG. 1, which facilitates adhesion of double-sided tape as shown at 24 in FIGS. 1 and 5.

The lid optionally has an integral extension 28 which has holes 12, 14 co-axial with receptacles 6 and 8 for receiving pipes and/or cigarettes (shown in phantom 26, 26' in FIG. 5) extending out of pipe/cigarette receptacles 6 and 8. Holes 12 and 14 are slightly larger than the openings of receptacles 6 and 8 and slightly larger than the diameter of a cigarette so that, when the box top and lid are opened and closed, the extensions do not damage cigarettes extending into the holes 12 and 14. One alternative embodiment has recesses rather than holes 12, 14.

In using the invention in conjunction with a cigarette box, the lid 10 is secured to the interior of the cigarette box top by suitable means, preferably double- sided (or two-way) tape 24. The double-sided tape may be secured to the lid in advance so that the user only needs to remove the tape backing on one side of the tape and secure it to the cigarette box. The cigarette box is emptied and the body is slipped into the major space of the box. Opening and closing the box top results in opening and closing the loose smoking material receptacle because the lid is secured to the box top and moves upwardly away from the loose smoking material receptacle by upward urging of the box top. A pipe 30 (FIG. 7) having a bowl on its end 32 is filled with loose smoking material by tamping the bowl down into loose smoking material receptacle 4.

One preferred embodiment of the invention is a kit including the body and lid, double-sided tape for securement of the lid to the cigarette box top interior, and written instructions associated with the body describing assembly of the insert within the cigarette box. These written instructions instruct the user to gently remove the foil lining from the inside of the cigarette box, remove the backing of the two-way tape affixed to the top of the lid, place the lid in the center of the cigarette box top, and place the base of the unit (i.e. the body) inside the cigarette box.

Although specific examples of the present invention and its application are set forth it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A cigarette box insert for a cigarette box having a space for holding cigarettes and a hinged top, the cigarette box insert comprising:

a body having a close fit in a cigarette box, said body having a first receptacle being a smoking material receptacle for holding loose smoking material, and a lid for the smoking material receptacle;

the smoking material receptacle having an opening at the top of the body, side walls extending down into the body, and a solid bottom, the smoking material receptacle extending less than the entire depth of the body; and the lid having a sealing member for plugging the opening of the smoking material receptacle such that the smoking material receptacle is opened by upward pressure on the lid.

2. The cigarette box insert of claim 1 wherein the sealing member is a rubber stopper secured to the lid by a screw.

3. The cigarette box insert of claim 2 wherein the lid has a relatively flat top surface for adhesive securement to the cigarette box top interior surface such that the lid is removed and the smoking material receptacle is opened when the cigarette box top is opened.

4. A cigarette box insert for a cigarette box having a space for holding cigarettes and a hinged top, the cigarette box insert comprising:

a body having a first receptacle being a smoking material receptacle for holding loose smoking material, a second receptacle for holding a pipe or cigarette, and a lid for the smoking material receptacle;

the smoking material receptacle having an opening at the top of the body, side walls extending down into the body, and a solid bottom, the smoking material receptacle extending less than the entire depth of the body;

the second receptacle having an opening at the top of the body and side walls extending down into the body; and the lid having a sealing member for plugging the opening of the smoking material receptacle such that the smoking material receptacle is opened by upward pressure on the lid.

5. The cigarette box insert of claim 4 wherein the sealing member is a rubber stopper secured to the lid by a screw.

6. The cigarette box insert of claim 5 wherein the lid has a relatively flat top surface for adhesive securement to the cigarette box top interior surface such that the lid is removed and the smoking material receptacle is opened when the cigarette box top is opened.

7. The cigarette box insert of claim 4 wherein the lid has an integral extension which extends over the second receptacle and has a recess therein aligned with the opening on the second receptacle for receiving a tip of a pipe or cigarette in the second receptacle.

8. The cigarette box insert of claim 4 wherein the lid has an integral extension which extends over the second receptacle and has an opening therein aligned with the opening on the second receptacle for receiving a tip of a pipe or cigarette extending out of the second receptacle.

9. The cigarette box insert of claim 8 wherein the lid has a relatively flat top surface for adhesive securement to the cigarette box top interior surface such that the lid is removed and the smoking material receptacle is opened when the cigarette box top is opened.

10. The cigarette box insert of claim 4 wherein the second receptacle is a bore open at both ends through the entire depth of the body.

11. A cigarette box insert comprising:

a body having a first receptacle being a smoking material receptacle therein for holding loose smoking material, and a lid for the smoking material receptacle;

the body having a stepped top, a first body portion and a second body portion, each of said body portions having an upper surface with the upper surface of the first body portion being at greater elevation than the upper surface of the second body portion; and the loose smoking material receptacle being housed within the first body portion and having an opening at the upper surface thereof.

12. The cigarette box insert of claim 11 wherein the body comprises a second receptacle housed within the second body portion and an opening for the second receptacle at the upper surface of the second body portion.

13. The cigarette box insert of claim 11 further comprising a lid having a sealing member for plugging the opening of the smoking material receptacle such that the smoking material receptacle is opened by upward pressure on the lid.

14. A cigarette box insert comprising:

a body having a first receptacle being a smoking material receptacle for holding loose smoking material, a second receptacle for holding a pipe or cigarette, and a lid for the smoking material receptacle;

the body having front, back, bottom and side surfaces, and being of such width, depth and height to snugly fit within a cigarette box;

the body having a stepped top, a first body portion and a second body portion, each of said body portions having an upper surface with the upper surface of the first body portion being at greater elevation than the upper surface of the second body portion;

the smoking material receptacle being housed within the first body portion and having an opening at the upper surface of the first body portion;

the second receptacle being housed within the second body portion and having an opening at the upper surface of the second body portion;

the lid having a relatively flat top surface for adhesive securement to the cigarette box top interior surface and a sealing member for plugging the opening of the smoking material receptacle such that the smoking material receptacle is opened by upward pressure on the lid; and the lid further having an integral extension which extends over the second receptacle and having an opening therein aligned with the opening on the second receptacle for receiving a tip of a pipe or cigarette extending out of the second receptacle.

15. A cigarette box insert kit comprising:

a body having a first receptacle being a smoking material receptacle for holding loose smoking material, a second receptacle for holding a pipe or cigarette, and a lid for the smoking material receptacle;

the body having front, back, bottom and side surfaces, and being of such width, depth and height to snugly fit within a cigarette box;

the smoking material receptacle having an opening at the top of the body, side walls extending down into the body, and a solid bottom, the smoking material receptacle extending less than the entire depth of the body;

the second receptacle having an opening at the top of the body and side walls extending down into the body;

the lid having a relatively flat top surface for adhesive securement to the cigarette box top interior surface and a sealing member for plugging the opening of the smoking material receptacle such that the smoking material receptacle is opened by upward pressure on the lid;

double-sided tape for securement of the lid to the cigarette box top interior; and written instructions associated with the body describing assembly of the insert within the cigarette box.

* * * * *